US007651353B2

(12) United States Patent
Laukhuf

(10) Patent No.: US 7,651,353 B2
(45) Date of Patent: Jan. 26, 2010

(54) MODULAR WALL PANEL ELECTRICAL ASSEMBLY

(75) Inventor: Gregg E. Laukhuf, Bryan, OH (US)

(73) Assignee: Group Dekko, Inc., Kendallville, IN (US)

( * ) Notice: Subject to any disclaimer, the term of this patent is extended or adjusted under 35 U.S.C. 154(b) by 0 days.

(21) Appl. No.: 11/542,884

(22) Filed: Oct. 4, 2006

(65) Prior Publication Data

US 2007/0077799 A1 Apr. 5, 2007

Related U.S. Application Data

(60) Provisional application No. 60/723,787, filed on Oct. 5, 2005.

(51) Int. Cl.
*H01R 4/60* (2006.01)

(52) U.S. Cl. ..... 439/215; 439/211

(58) Field of Classification Search ..... 439/215, 439/535, 654, 557, 309, 211, 210, 207; 174/481
See application file for complete search history.

(56) References Cited

U.S. PATENT DOCUMENTS

| | | | | |
|---|---|---|---|---|
| 2,932,683 | A | 4/1960 | Flachbarth | 174/48 |
| 4,017,137 | A * | 4/1977 | Parks | 439/135 |
| 4,135,775 | A * | 1/1979 | Driscoll | 439/215 |
| 4,313,646 | A | 2/1982 | Millhimes et al. | 339/156 |
| 4,740,167 | A | 4/1988 | Millhimes et al. | 439/92 |
| 4,808,768 | A * | 2/1989 | Sireci | 174/480 |
| 4,872,849 | A * | 10/1989 | Long | 439/209 |
| 4,952,163 | A * | 8/1990 | Dola et al. | 439/211 |
| 4,952,164 | A | 8/1990 | French et al. | 439/215 |
| 5,135,411 | A * | 8/1992 | Wiley et al. | 439/535 |
| 5,164,544 | A * | 11/1992 | Snodgrass et al. | 174/495 |
| 5,236,370 | A * | 8/1993 | King et al. | 439/215 |
| 5,336,097 | A | 8/1994 | Williamson, Jr. et al. | 439/94 |
| 6,186,825 | B1 | 2/2001 | Bogiel et al. | 439/532 |
| 6,253,509 | B1 * | 7/2001 | Hellwig et al. | 52/239 |
| 6,435,916 | B1 * | 8/2002 | Amberg et al. | 439/651 |
| 6,575,777 | B2 | 6/2003 | Henriott | 439/215 |
| 6,752,653 | B1 * | 6/2004 | Morlock et al. | 439/527 |
| 6,885,796 | B2 * | 4/2005 | Lubkert et al. | 385/48 |
| 6,955,559 | B2 | 10/2005 | Pyrros | 439/535 |
| 7,131,865 | B2 * | 11/2006 | Tsai et al. | 439/557 |
| 2003/0194904 | A1 * | 10/2003 | Rupert et al. | 439/489 |
| 2006/0024996 | A1 * | 2/2006 | Johnson et al. | 439/215 |
| 2006/0094290 | A1 | 5/2006 | Pyrros | 439/535 |

* cited by examiner

*Primary Examiner*—Tho D Ta
(74) *Attorney, Agent, or Firm*—Taylor & Aust, P.C.

(57) ABSTRACT

A modular wall panel system including at least one wall panel having a raceway with at least one receptacle opening therein and at least one receptacle assembly. The at least one receptacle assembly includes a retaining device that retains the receptacle to the raceway and a restraining feature that restrains the receptacle assembly from completely entering the opening.

19 Claims, 1 Drawing Sheet

MODULAR WALL PANEL ELECTRICAL ASSEMBLY

CROSS REFERENCE TO RELATED APPLICATIONS

This is a non-provisional application based upon U.S. provisional patent application Ser. No. 60/723,787, entitled "BACK-TO-BACK DUPLEX RECEPTACLES", filed Oct. 5, 2005.

BACKGROUND OF THE INVENTION

1. Field of the Invention

The present invention relates to a wiring assembly utilized in a modular wall panel, and, more particularly, to outlet receptacles utilized in an electrical assembly for a modular wall panel.

2. Description of the Related Art

Modular wall panels are utilized as part of an office modulization system wherein individualized office spaces are created by the placement of modular wall panels, which may be free standing or connected to structures of the room in which the modular wall panel system is installed. Modular wall panels are utilized so that the capital costs of renovation are kept low. Further, modular wall panels can be easily utilized in leased space without altering the structure of the building. Modular wall panels are arranged to accommodate electrical and data access so that each office cubical can utilize those respective utilities.

Modular wall panels often include a wiring raceway in which electrical and data conductors are run to appropriate outlets for interconnection with equipment contained in each office cubical. Individual wall panels are typically interconnected along a vertical edge and electrical and/or data connections are interconnected between the individual wall panels.

Modular wall systems are used in many situations to construct temporary, or at least rearrangeable office configurations. With the proliferation of computer work stations, and the decreasing costs for obtaining and operating various office equipment including printers, scanners, fax machines and the like, the installations of such equipment have increased, and there is an ever increasing need for electrical, communication and data transmission circuits in each defined work space. Rearrangement of the work space defined by the panels, and/or rearrangement of the equipment within the work space can result in the need to relocate the various receptacles to avoid unsightly and unsafe dependence on extension cords.

To meet the need for relocatable and expandable electrical, data and communication circuitry in modular wall systems, it is known to provide a wire raceway in the modular wall, commonly near the bottom thereof. Circuit components may include distribution, jumper and receptacle elements that can be combined and configured to achieve the desired outlet locations.

As needs have increased, it has become more common to require receptacles on both sides of the modular wall. Separate distribution components can be used, but this requires a relatively large wire race, and can result in an undesirable amount of wires or cables in the wire raceway.

What is needed in the art is a quick economical method of wiring modular wall panels.

SUMMARY OF THE INVENTION

The present invention provides snap-in electrical receptacles for a modular wall panel.

The invention in one form is directed to a modular wall panel system including at least one wall panel having a raceway with at least one receptacle opening therein and at least one receptacle assembly. The at least one receptacle assembly includes a retaining device to retain the receptacle to the raceway and a restraining feature which restrains the receptacle assembly from completely entering the opening.

The present invention advantageously snaps into a standard opening of a raceway.

Another advantage of the present invention is that outlets are positioned on opposite sides of the receptacle allowing the receptacle assembly to provide power to both sides of the modular wall panel.

Yet another advantage of the present invention is that a wiring harness extends from the receptacle assembly to extend along a wiring raceway for connection to electrical power.

Yet another advantage of the present invention is that the retaining features are depressible so as to allow the removal of the electrical receptacle assembly from the wiring raceway.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
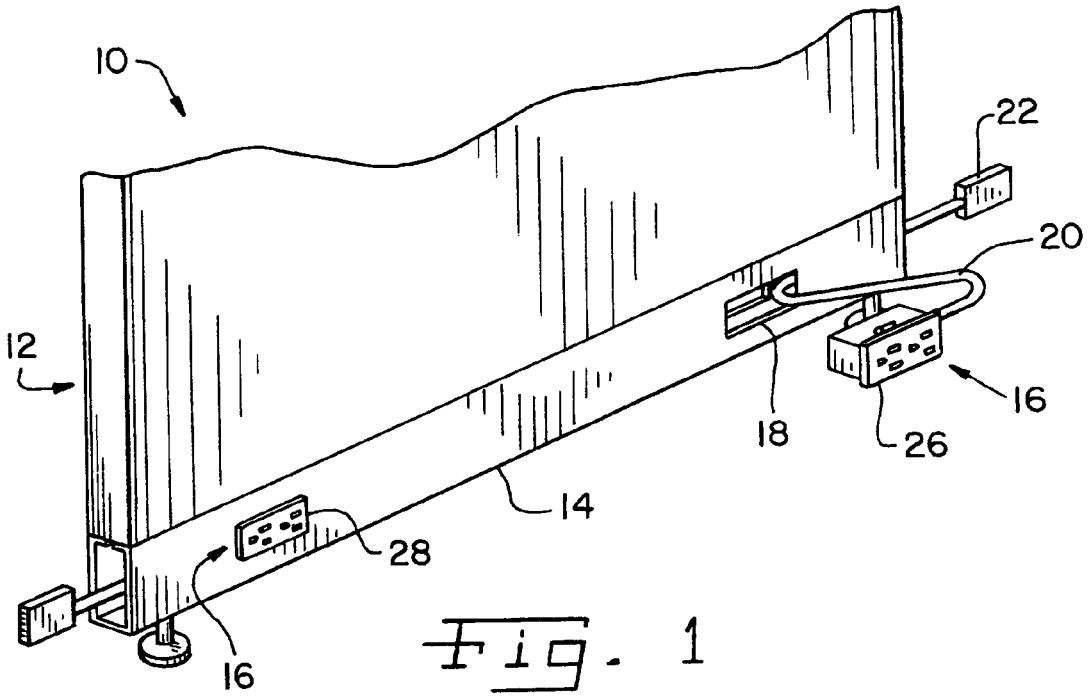
FIG. 1 is a partial perspective view of a modular wall panel system utilizing one embodiment of a receptacle assembly of the present invention.
Figure 2:
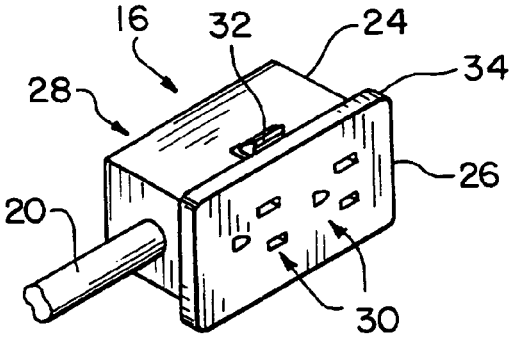
FIG. 2 is a perspective view of one side of the receptacle assembly of FIG. 1.
Figure 3:
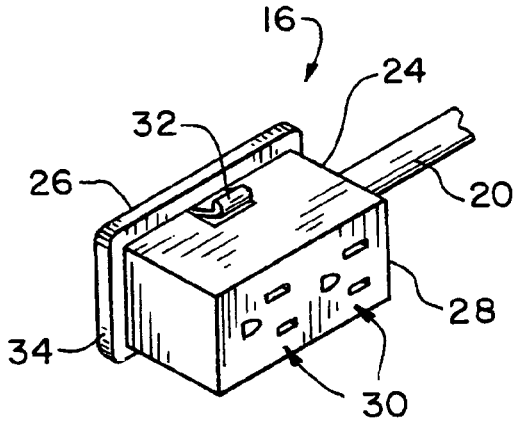
FIG. 3 is an opposite perspective view of the receptacle assembly of FIGS. 1 and 2.

Referring now to the drawings, and more particularly to FIGS. 1-3, there is shown a modular wall panel system 10 including at least one wall panel 12 having a wiring raceway 14. Receptacle assemblies 16 are inserted into raceway 14 to provide electrical power along a portion of wall panel 12. Raceway 14 includes several openings 18 of a quasi-rectangular nature to receive electrical outlets or receptacle assemblies 16.

Receptacle assembly 16 includes a wiring harness 20 also known as a wiring cable 20 that extends from receptacle assembly 16 and interconnects, by way of connector 22, to an electrical power source. Receptacle assembly 16 is connected to raceway 14 by extending wiring cable 20, along with connector 22, through an opening 18 and then by inserting receptacle assembly 16 in through opening 18 and snapping receptacle assembly 16 in place.

Receptacle assembly 16 includes a housing 24 having a first face 26 and a second face 28. Electrical outlets 30 are positioned on both first face 26 and second face 28. Retaining devices 32 are located along sides of housing 24 that extend between faces 26 and 28. Retaining device 32 may be a biased arm 32 with a engaging hook to connect with an inside surface of raceway 14 when receptacle assembly 16 is assembled to raceway 14. A restraining feature 34 may be a part of housing 24 or may be connected to housing 24. Restraining feature 34 can be considered a raised portion of housing 24 or an edge of housing 24 that extends outwardly. Restraining feature 34 is larger than opening 18 so as to prevent receptacle assembly 16 from completely entering opening 18. Openings 18 are aligned on both sides of raceway 14 so as to allow opposing sides 26 and 28 of receptacle assembly 16 to provide electrical power to both sides of wall panel 12. Space exists between restraining feature 34 and retaining device 32 which approximates the thickness of the outer wall of raceway 14. Retaining device 32 is a biased arm that may be depressed with the use of a tool, such as a screwdriver so as to allow the removal of receptacle assembly 16 from raceway 14.

Receptacle assembly 16 is assembled to raceway 14 by inserting connector 22 and cable 20 through an opening 18 and extending cable 20 towards an end of raceway 14 so as to allow for the electrical connection of connector 22. Second face 28, which is smaller in overall surface area than first face 26 is inserted into opening 18 on one side of raceway 14 and a substantial portion of receptacle assembly 16 is inserted through opening 18. The opening on the opposite side of raceway 14 is in alignment with opening 18 on the first side so as to allow second face 28 to align with the opening on the opposite side of raceway 14. Second face 28 may extend into a portion of this opening on the opposite side of raceway 14 as shown in receptacle assembly 16 on the left side of FIG. 1.

The present invention takes advantage of standard conventional assemblies including raceways 14 having openings on opposite sides thereof. Further, Applicants invention requires no alteration in the size of openings 18 whereas housing 24 is sized to accommodate standard openings in raceway 14. The present invention is easily inserted into raceways 14 without the use of tools since receptacle assembly 16 can be simply pressed into the openings, as biased arms 32 bend toward the side of housing 24 as they encounter edges of opening 18. Once fully inserted biased arms 32 extend outwardly again from housing 12 to catch the inner surface of raceway 14.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular wall panel system, comprising:

at least one wall panel including a raceway having an end opening and at least one receptacle opening therein, said raceway having a wall with an inner surface and an outer surface; and at least one receptacle assembly installed in a corresponding one of said at least one receptacle opening including:

a housing having at least one wall;

a retaining device extending from said housing, said retaining device directly retaining said receptacle to said wall of said raceway;

a restraining feature restraining said receptacle assembly from completely entering said opening, said restraining feature and said retaining device configured to act together to retain said receptacle assembly in said receptacle opening, said retaining device contacting said inner surface, said restraining feature contacting said outer surface; and a wiring cable passing through said wall of said housing, said wiring cable being configured to enter through said receptacle opening and extend without other interconnection through said end opening.

2. The modular wall panel system of claim 1, wherein said retaining device snappingly retains said at least one receptacle assembly to an inside surface of said raceway.

3. The modular wall panel system of claim 2, wherein said retaining device is an arm biased generally away from said housing.

4. The modular wall panel system of claim 3, wherein said arm is connected to and extends from a portion of said housing.

5. The modular wall panel system of claim 1, wherein said housing includes an extended edge that is said restraining feature.

6. The modular wail panel system of claim 5, wherein said at least one receptacle assembly is an integral assembly and includes at least one electrical outlet on each of two opposing sides of said receptacle assembly, said two opposing sides including a first side and a second side, said first side having a first surface area, said second side having a second surface area smaller than said first surface area.

7. The modular wall panel system of claim 6, wherein said at least one opening includes a first opening and a second opening, said first opening being on one side of said raceway and said second opening being on an opposite side of said raceway, said first opening and said second opening being aligned with each other so that said receptacle assembly is inserted substantially through said first opening, one of said two opposing sides being positioned proximate said second opening.

8. The modular wall panel system claim 7, wherein said wiring cable has a first end and a second end, said wiring cable including a connector connected to said first end, said second end being the end that passes through said wall.

9. A receptacle assembly for use in a modular wall panel having a raceway having a wall with an inner surface, an end opening and an outer surface, the receptacle assembly, comprising:

a housing;

a retaining device connected to said housing, said retaining device directly retaining said receptacle to the raceway;

a restraining feature extending from said housing, said restraining feature restraining the receptacle assembly from completely entering an opening in the raceway, said restraining feature and said retaining device configured to act together to retain said receptacle assembly in said receptacle opening, said retaining device contacting said inner surface, said restraining feature contacting said outer surface; and a wiring cable extending through said housing, said wiring cable being configured to enter through said receptacle opening and extend without other interconnection through said end opening.

10. The receptacle assembly of claim 9, wherein said retaining device snappingly engages an inside surface of the raceway.

11. The receptacle assembly of claim 10, wherein said retaining device is an arm biased generally away from said housing.

12. The receptacle assembly of claim 11, wherein said arm is connected to and extends from a portion of said housing.

13. The receptacle assembly of claim 9, wherein said housing includes at least one electrical outlet on each of two opposing sides of said housing.

14. The receptacle assembly of claim 13, wherein said opening is a first opening, the raceway additionally having a second opening, the first opening being on one side of the raceway and the second opening being on an opposite side of the raceway, the first opening and the second opening being aligned with each other so that the receptacle assembly is inserted substantially through the first opening, one of the two opposing sides being positioned proximate the second opening.

15. The receptacle assembly of claim 14, wherein said wiring cable having a first end and a second end, said wiring cable including a connector connected to said first end, said second end extending through housing.

16. A method of assembling an electrical system to a wall panel, comprising the steps of:

inserting a wiring cable of a receptacle assembly through an opening in a raceway of the wall panel;

extending said cable through an end opening in the raceway without other electrical connection in the raceway;

inserting a first face of a housing of said receptacle assembly into said opening in raceway of the wall panel, said raceway having a wall with an inner surface and an outer surface, said first face extending into another opening in said raceway said receptacle assembly having at least one electrical outlet on each of said first face and an opposite second face of said housing; and pressing said receptacle assembly until retaining devices retain said receptacle assembly to said raceway, said retaining devices contacting said inner surface.

17. The method of claim 16, wherein said first face having a surface area that is smaller than a surface area of said second face.

18. The method of claim 17, wherein said opening and said other opening are in alignment with each other.

19. The method of claim 18, further comprising the step of entering a wiring harness connected to said receptacle assembly into said opening prior to said inserting step.

* * * * *